US006260815B1

(12) United States Patent
Allen

(10) Patent No.: US 6,260,815 B1
(45) Date of Patent: Jul. 17, 2001

(54) ADJUSTABLE FURNACE SUPPORT

(76) Inventor: Robert Allen, 753 Arabesque Cir., Roseville, CA (US) 95678

( * ) Notice: Subject to any disclaimer, the term of this patent is extended or adjusted under 35 U.S.C. 154(b) by 0 days.

(21) Appl. No.: 09/514,604

(22) Filed: Feb. 28, 2000

(51) Int. Cl.[7] ..... F16M 9/00; E04B 5/48

(52) U.S. Cl. ..... 248/670; 248/678; 248/176.3; 248/188.2; 52/19; 285/44

(58) Field of Search ..... 248/678, 443, 248/444.1, 448, 205.9, 188.2, 247, 250, 670; 52/105

(56) References Cited

U.S. PATENT DOCUMENTS

| | | | | |
|---|---|---|---|---|
| 2,882,810 | | 4/1959 | Goetth . | |
| 4,428,166 | * | 1/1984 | Burghart | 52/19 |
| 4,526,091 | * | 7/1985 | Sharp | 98/39.1 |
| 4,895,066 | * | 1/1990 | Carnahan | 98/42.22 |
| 5,255,887 | | 10/1993 | Schumacher et al. | 248/676 |
| 5,308,037 | | 5/1994 | Gonzalez | 248/670 |
| 5,407,171 | | 4/1995 | Gonzalez | 248/670 |
| 5,409,266 | * | 4/1995 | Baker | 285/44 |
| 5,454,538 | | 10/1995 | Merideth | 248/237 |
| 5,595,031 | * | 1/1997 | Commins | 52/264 |
| 5,997,118 | * | 12/1999 | McBrayer | 312/334.44 |

* cited by examiner

*Primary Examiner*—Leslie A. Braun
*Assistant Examiner*—Steven Marsh
(74) *Attorney, Agent, or Firm*—Thomas R. Lampe

(57) ABSTRACT

Two telescopically interconnected support members of an adjustable furnace support are secured together by mechanical fasteners. The mechanical fasteners maintain the top end of one of the support members a fixed predetermined distance from the bottom of the other support member. A furnace support ledge extends inwardly from the sides of one of the support members. The furnace support ledge also supports a furnace filter below the furnace.

11 Claims, 4 Drawing Sheets

ADJUSTABLE FURNACE SUPPORT

TECHNICAL FIELD

This invention relates to a support for furnaces that is adjustable to enable the furnace to be supported a desired predetermined distance above a floor.

BACKGROUND OF THE INVENTION

It is a well known practice to provide support stands for furnaces, the stands maintaining the bottom of the furnace a fixed distance from a floor. Conventional furnace support stands, however, cannot be adjusted and it is standard practice for heating supply companies and heating contractors to maintain a stock of stands of many different sizes. In contrast, as will be seen in detail below, the furnace support stand of the present invention can be readily adjusted to provide a stable support for a furnace under varying conditions and circumstances. For example, using the furnace support stand of the present invention, the dimensions of replacement furnaces can readily be accommodated, the stand being adjusted to position the furnace at the desired location relative to the duct work and other structures associated with the replaced furnace even though there is a difference in furnace size. The furnace support stand of the present invention can be placed directly on an old stand or the old stand may be replaced in its entirety, as desired.

It is also important to note that with prior art fixed size furnace support stands even a large inexpensive inventory of different sizes might not necessarily be sufficient to accommodate the variations one encounters with regard to the furnace and related duct work, etc., requiring the installer to take time consuming actions, such as positioning shims or other supports under the furnace support stand or furnace, in order to bring the furnace to the desired elevation.

The following patents are directed to supports of various types: U.S. Pat. No. 2,882,810, issued Apr. 21, 1959, U.S. Pat. No. 5,454,538, issued Oct. 3, 1995, U.S. Pat. No. 5,255,887, issued Oct. 26, 1993, U.S. Pat. No. 5,407,171, issued Apr. 18, 1995, and U.S. Pat. No. 5,308,037, issued May 3, 1994. The patents do not teach or suggest the unique combination of structural elements disclosed and claimed herein.

DISCLOSURE OF INVENTION

The present invention relates to an adjustable furnace support including a first support member formed of sheet metal including interconnected first support member side walls forming spaced first support member corners. The first support member defines a first support member interior, an open first support member top and an open first support member bottom. The open first support member top and the open support member bottom both are in communication with the first support member interior.

The adjustable furnace support also includes a second support member formed of sheet metal having a second support member bottom and including interconnected second support member side walls extending upwardly from the second support member bottom and forming spaced second support member corners. The second support member defines a second support member interior and an open second support member top communicating with the second support member interior. The first support member and the second support member are telescopically interconnected.

Attachment means is cooperable with the first and second support members for selectively retaining the first and second support members at predetermined positions relative to one another to maintain the top end of the first support member a fixed predetermined distance from the second support member bottom.

Other features, advantages, and objects of the present invention will become apparent with reference to the following description and accompanying drawings.

BEST MODE FOR CARRYING OUT THE INVENTION

Figure 1:
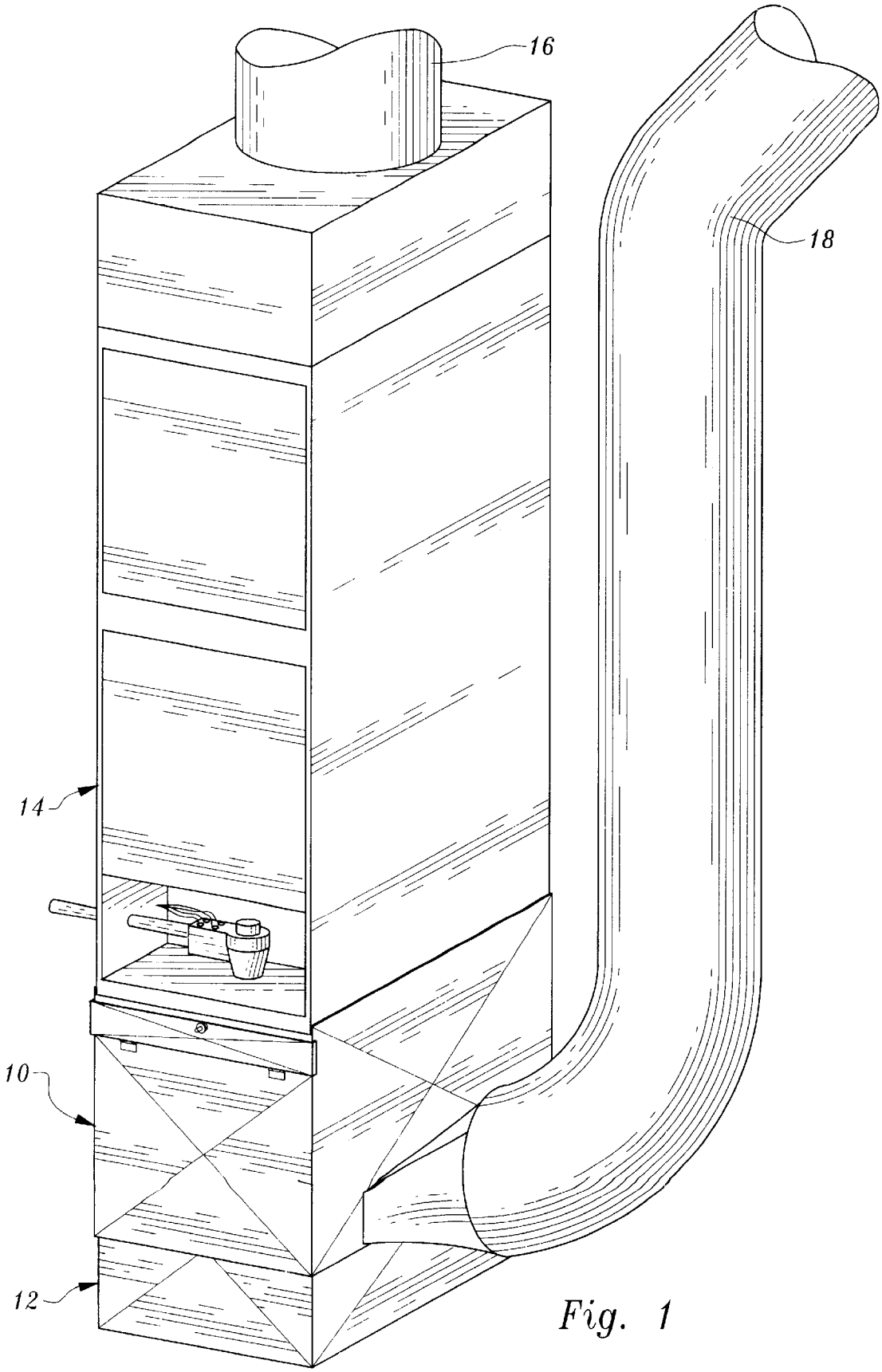
FIG. 1 is a perspective view illustrating an adjustable furnace support constructed in accordance with the teachings of the present invention supporting a furnace and in operative association with furnace duct work.

Referring now to the drawings, the adjustable furnace support of the present invention includes a first support member 10 formed of sheet metal and a second support member 12 also formed of sheet metal.

Figure 3:
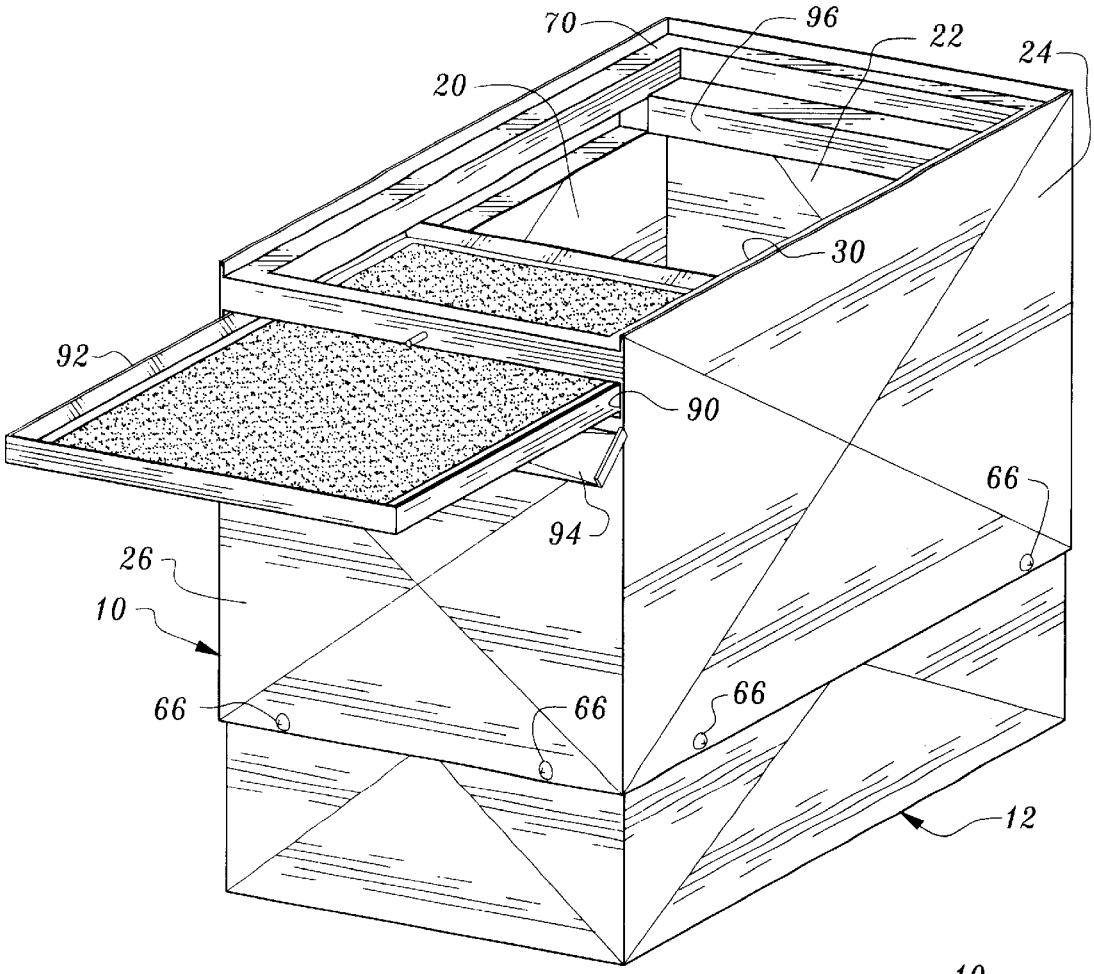
FIG. 3 is a perspective view illustrating the support members assembled.

When the adjustable furnace support is assembled and in use the first support member and the second support member are telescopically interconnected and secured together. This condition is illustrated in FIGS. 1 and 3, FIG. 1 showing the adjustable furnace support supporting a furnace 14 having duct work 16 and 18 operatively associated therewith in a well known manner. In the disclosed arrangement the lower end of duct work 18 leads to a hole (not shown) cut into a side of the furnace support and passing through both the first support member 10 and the second support member 12.

The first support member 10 includes four side walls 20, 22, 24, 26 which are interconnected and form four corners, as shown. The first support member 10 defines a first support member interior 28, an open first support member top 30 and a first support member bottom 32 which is also open. The first support member has a rectangular-shaped periphery.

Figure 8:
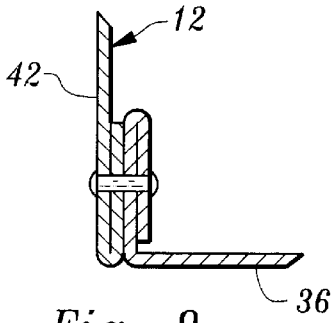
FIG. 8 is an enlarged, cross-sectional view taken along the line 8—8 in FIG. 2.

The second support member 12 has a second support member bottom 36 which may be open or closed (in the illustrated embodiment the bottom is closed) and includes interconnected second support member side walls 38, 40, 42, 44 which extend upwardly from bottom 36 and form four spaced second support member corners. FIG. 8 shows the bottom riveted to one of the side walls, side wall 42. Spot welding or other suitable techniques could also be used. The second support member 12 defines a second support member interior 46 which is in communication with the open second support member top 48.

The second support member 12 has a rectangular-shaped periphery which is somewhat smaller than the periphery of first support member 10 so that the first support member 10 may be slid over second support member 12, as shown in FIG. 3, for example, in telescopic relationship therewith.

Figure 2:
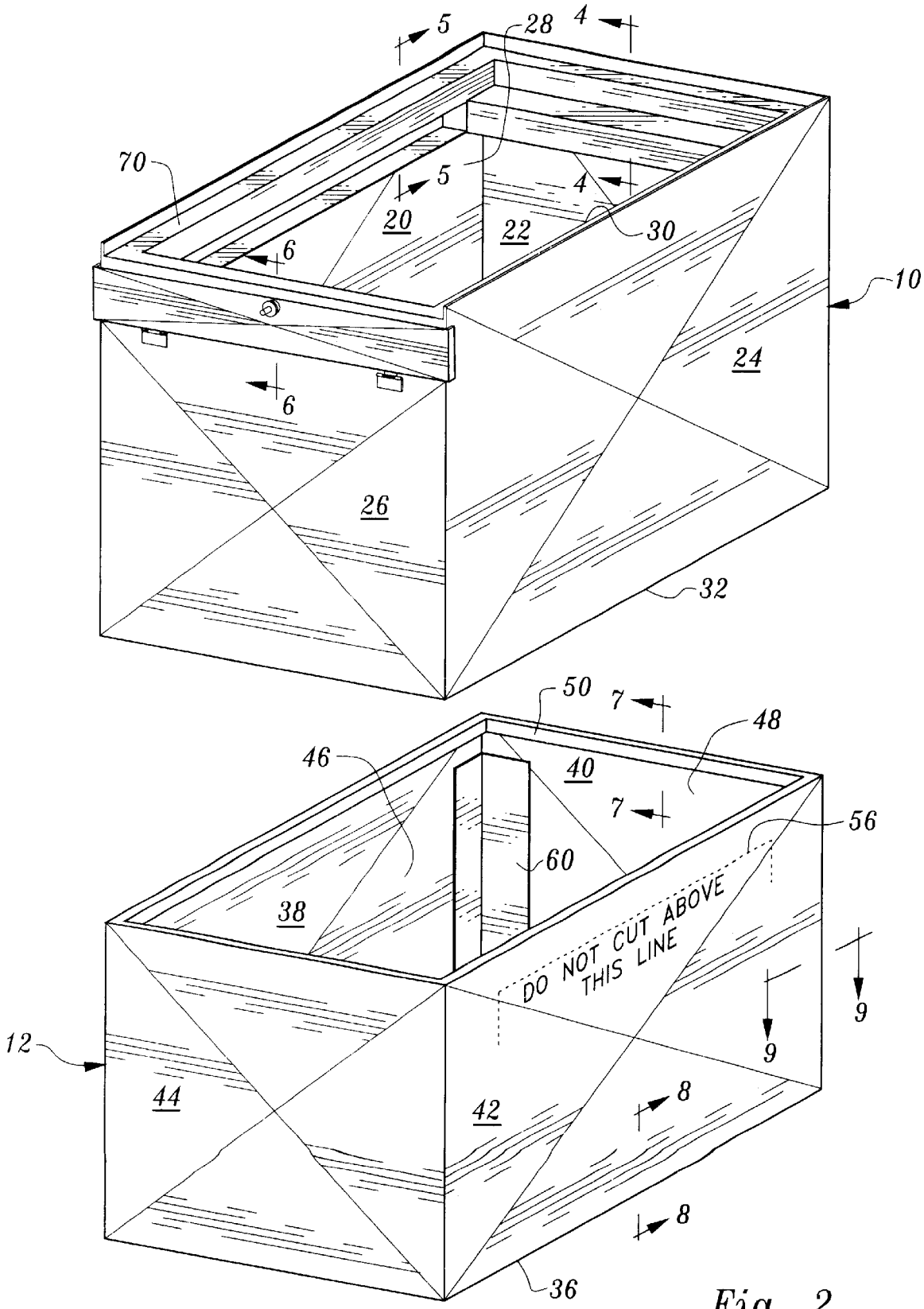
FIG. 2 is an exploded, perspective view illustrating two support members of the adjustable furnace support prior to assembling them together.
Figure 7:
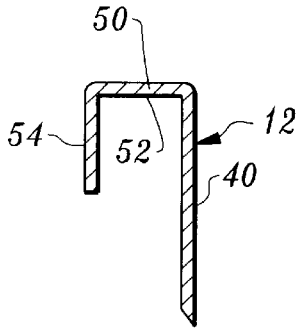
FIG. 7 is an enlarged, cross-sectional view taken along the line 7—7 in FIG. 2.

A reinforcement rib 50 is integral with the second support member side walls and extends inwardly from the second support member side walls at the open top of the second support member. As may best be seen with reference to FIG. 7, the reinforcement rib 50 has a horizontal rib component 52 attached directly to the second support member side walls and a vertical reinforcement rib component 54 attached to the horizontal rib component and extending downwardly into the interior of the second support member. Indicia 56 (FIG. 2) is on at least one of the second support member side walls below the elevation of the reinforcement rib 50 giving notice not to cut the support member side walls at the rib location so that the structural integrity provided by the reinforcement rib will not be compromised.

Figure 9:
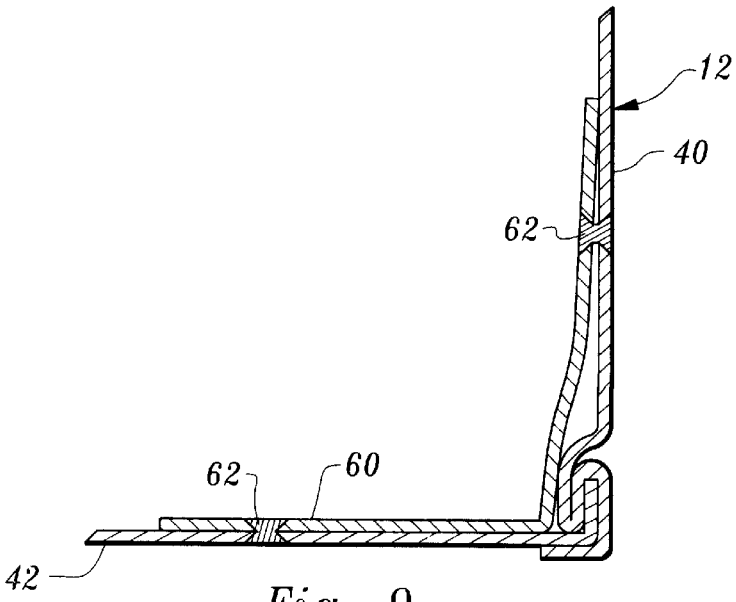
FIG. 9 is an enlarged, cross-sectional view taken the line 9—9 in FIG. 2.

A sheet metal reinforcement strip 60 is located at each of the corners of the second support member 12. The strips are spot welded or otherwise secured to adjacent second support member side walls at the corners, each reinforcement strip 60 extending over a corner. FIG. 9 provides details of the reinforcement strip 60 located at the corner formed by side walls 40, 42, the reinforcement strip being secured thereto by spot welds 62.

To maintain the desired predetermined distance between the top end of the first support member and the bottom end of the second support member when the support members are telescoped, sheet metal screws 66 are employed. In the arrangement illustrated, two sheet metal screws are applied at each corner, the screws passing through the side walls of the support members and also through the reinforcement strips 60 so that at least three sheet metal plies are employed at the superposed corners to reduce the risk of failure at the location of the fasteners.

First support member 10 includes a ledge 70 projecting inwardly from first support member side walls for engagement by the furnace to support the furnace. The ledge 70 extends inwardly from the first support member side walls to which it is affixed and is integral with the first support member side walls.

The ledge includes a vertical ledge portion 72 disposed parallel to and closely adjacent to the side walls as well as a horizontal ledge portion 74 attached to the vertical ledge portion and projecting into the first support member interior below the open first support member top. This arrangement is illustrated in FIGS. 4 and 5, for example.

The ledge 70 also includes a lower end portion 76 extending downwardly from the horizontal ledge portion and toward the first support member side walls.

Figure 4:
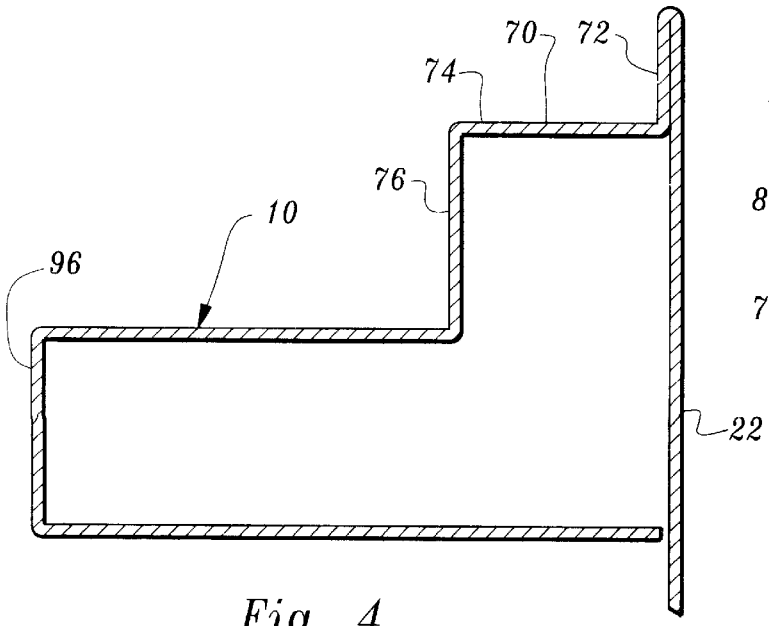
FIG. 4 is an enlarged, cross-sectional view taken along the line 4—4 of FIG. 2.
Figure 5:
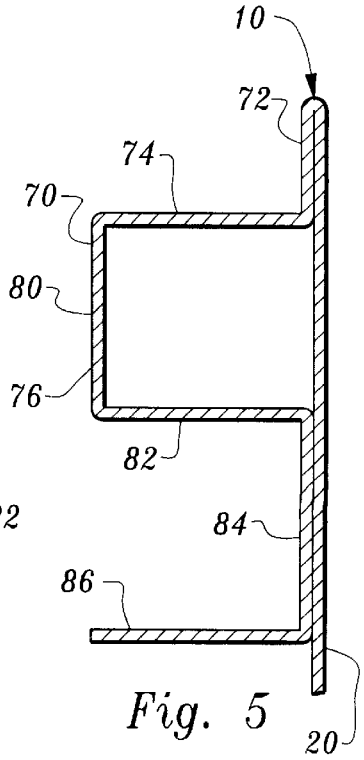
FIG. 5 is an enlarged, cross-sectional view taken along the line 5—5 in FIG. 7.
Figure 6:
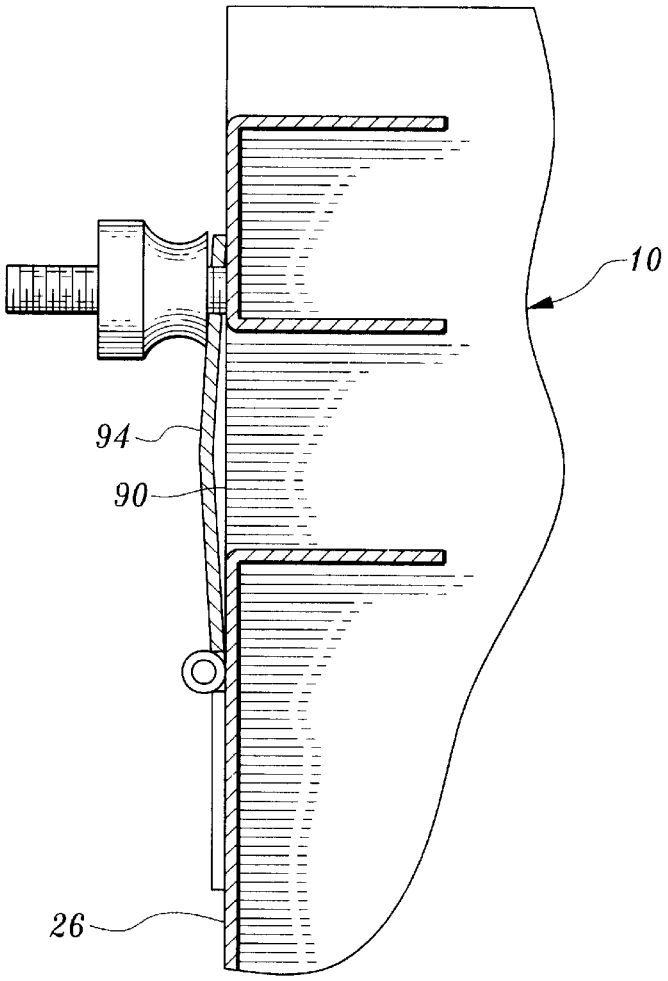
FIG. 6 is an enlarged, cross-sectional view taken the line 6—6 in FIG. 2.

The lower end portion 76 has different configurations along the length thereof, these configurations being shown in FIGS. 4 and 5, respectively. The lower end portion 76 has the configuration shown in FIG. 5 where it runs along side walls 20 and 24 and has the configuration shown in FIG. 4 where it extends along side wall 22.

The FIG. 5 configuration of the lower end portion includes a first vertical plate 80 extending downwardly from the horizontal ledge portion 74, a first horizontal plate 82 extending from plate 80 to a first support member side wall, a second vertical plate 84 extending from plate 82 engaging and disposed parallel to a first support member side wall and a second horizontal plate 86 extending from the second vertical plate 84 into the first support member interior.

Side wall 26 defines an opening 90 which is in communication with the channel formed at side walls 20, 24 by plates 82, 84, 86 so that a furnace air filter 92 can be readily installed or removed as shown in FIG. 3. A door 94 is provided which is movable between an open position wherein the channel is accessible for furnace air filter installation or removal and a closed position wherein the channel is covered along with any furnace air filter disposed therein. A suitable latch 98 is used to secure the door in closed condition.

An abutment surface 96 is formed on that length of the ledge 70 running along side wall 22 to be engaged by the furnace air filter and maintain it in proper position within the adjustable furnace support and reduce or eliminate air flow between the filter and furnace support at that location.

What is claimed is:

1. An adjustable furnace support comprising, in combination:

a first support member formed of sheet metal including interconnected substantially planar first support member side walls forming spaced first support member corners, said first support member defining a first support member interior, an open first support member top and an open first support member bottom, said open first support member top and said open support member bottom both being in communication with said first support member interior;

a second support member formed of sheet metal having a second support member bottom and including interconnected substantially planar second support member side walls extending upwardly from said second support member bottom and forming spaced second support member corners, said second support member defining a second support member interior and an open second support member top communicating with said second support member interior, said first support member and said second support member being telescopically interconnected;

attachment means cooperable with said first and second support members selectively retaining the first and second support members at predetermined positions relative to one another with the first support member side walls parallel to the second support member side walls and maintaining the top end of said first support member a fixed predetermined distance from the second support member bottom, said first support member additionally including a furnace support ledge projecting inwardly from said first support member side walls for engagement by a furnace to support the furnace above the second support member, said furnace support ledge extending inwardly from said first support member side walls and integral with said first support member side walls, said furnace support ledge including a vertical ledge portion disposed substantially parallel and closely adjacent to said first support member side walls and an inwardly extending horizontal ledge portion for engagement by a furnace attached to said vertical ledge portion and projecting into the first support member interior below said open first support member top whereby a furnace engaging the inwardly extending horizontal ledge portion is surrounded by the first support member side walls; and channel defining means disposed along said first support member side walls defining a channel for receiving and supporting a furnace air filter below said open first support member top and below the inwardly extending horizontal ledge portion, said furnace support ledge further including a lower end portion extending downwardly from said horizontal ledge portion, said lower edge portion at least partially comprising said channel defining means.

2. The adjustable furnace support according to claim 1 wherein said first support member includes four interconnected first support member side walls forming four first support member corners and wherein said second support member includes four interconnected second support member side walls forming four second support member corners each of said first and second support members having a rectangular-shaped periphery.

3. The adjustable furnace support according to claim 1 wherein said attachment means comprises mechanical fasteners located at corners of said first and second support members and extending between said first and second support members.

4. The adjustable furnace support according to claim 3 wherein said first support member corners and said second support member are superposed, said first and second support members corners at said superposed corners forming at least three sheet metal plies, said attachment means comprising sheet metal screws passing through said at least three sheet metal plies at said superposed corners.

5. The adjustable furnace support according to claim 1 wherein one of said first support member walls defines an opening in communication with said channel for selectively inserting a furnace air filter into said channel or removing a furnace air filter from said channel.

6. The adjustable furnace support according to claim 5 additionally comprising a door movable between an open position wherein said channel is accessible for furnace air filter installation or removal and a closed position wherein said channel is covered along with any furnace air filter disposed therein.

7. The adjustable furnace support according to claim 1 wherein said lower end portion of said furnace support ledge has an abutment surface for abutting engagement by a furnace air filter in said channel.

8. The adjustable furnace support according to claim 4 wherein one of said sheet metal plies comprises a sheet metal reinforcement strip secured to adjacent first support member side walls at said corners and extending over said first support member corners.

9. The adjustable furnace support according to claim 1 wherein said second support member additionally includes a reinforcement rib integral with said second support member side walls and extending inwardly from said second support member side walls at said second support member top, said reinforcement rib having a generally horizontal rib component attached directly to said second support member side walls and a generally vertical reinforcement rib component attached to said generally horizontal rib component and extending downwardly into said second support member interior.

10. The adjustable furnace support according to claim 9 wherein indicia is on at least one of said second support member side walls below the elevation of said reinforcement rib giving notice not to cut said support member side walls at said rib location.

11. The adjustable furnace support according to claim 1 wherein the lower end portion has different configurations along the length thereof, two spaced, parallel segments of said lower end portion defining said channel and including a first generally vertical plate extending downwardly from said horizontal ledge portion, a first generally horizontal plate extending from said first generally vertical plate to a first support member side wall, a second generally vertical plate extending from said first generally horizontal plate engaging and disposed parallel to a first support member side wall and a second generally horizontal plate extending from said second generally vertical plate into said first support member interior.

* * * * *